United States Patent [19]

Rajnik

[11] Patent Number: 4,508,031

[45] Date of Patent: Apr. 2, 1985

[54] FLEXIBLE MEMBRANE PRINTING APPARATUS FOR A DECORATING MACHINE

[75] Inventor: Lawrence S. Rajnik, Corning, N.Y.

[73] Assignee: Corning Glass Works, Corning, N.Y.

[21] Appl. No.: 578,049

[22] Filed: Feb. 8, 1984

Related U.S. Application Data

[63] Continuation of Ser. No. 332,723, Dec. 21, 1981, abandoned.

[51] Int. Cl.[3] ..... B41F 17/00

[52] U.S. Cl. ..... 101/41; 101/426

[58] Field of Search ..... 101/41–44, 101/35, 426, 150, 163

[56] References Cited

U.S. PATENT DOCUMENTS

| | | | |
|---|---|---|---|
| 2,077,790 | 4/1937 | Hakogi | 101/41 X |
| 2,124,711 | 7/1938 | Rowell | 101/41 |
| 2,745,339 | 5/1956 | Fernandez | 101/41 |
| 2,748,696 | 6/1956 | Murray | 101/41 |
| 2,842,046 | 7/1958 | Murray | 101/41 |
| 2,904,916 | 9/1959 | Stahmann | 101/41 X |
| 3,868,901 | 5/1975 | Valiela . | |
| 4,098,184 | 7/1978 | Okada et al. | 101/41 |
| 4,261,749 | 4/1981 | Johnson . | |

*Primary Examiner*—Clifford D. Crowder
*Attorney, Agent, or Firm*—B. R. Turner

[57] ABSTRACT

A flexible membrane pickup surface for receiving thereon one or more color portions of a design. A backing member is provided in opposition to a design receiving side of the membrane to rigidly locate it in a plane while receiving the color. The backing member has pore openings therein coupled to a source of reduced atmosphere for drawing the membrane thereagainst. In a printing mode the membrane is pressed against a ware surface by means of a pressing head having a shape causing a selected contact angle across the ware surface.

18 Claims, 9 Drawing Figures

FLEXIBLE MEMBRANE PRINTING APPARATUS FOR A DECORATING MACHINE

This is a continuation of application Ser. No. 332,723, filed Dec. 21, 1981, now abandoned.

BACKGROUND OF THE INVENTION

The present invention relates to a printing apparatus and a method of carrying out various printing functions. Although many applications for the invention may be possible, the disclosure herein emphasizes the application to ware decoration. It should be understood that articles of many types may be printed or decorated using the apparatus and method of the present invention and such applications are part of the invention herein.

In multicolor ware decoration, speed, versatility, ease of setup, quality of reproduction, accuracy of registration, and cost effectiveness are important factors to consider. State of the art decorating devices approach some but not all of the above factors satisfactorily. The present invention was developed for various reasons including a desire to both take advantage of the latest ink and elastomer technology and to maximize printing coverage and rates without sacrifice of registration.

The apparatus of the present invention is preferably adapted for use in a printing machine described in a copending U.S. patent application referred to below. That device makes use of two geometric relationships. First, a cone when placed on the flat surface and rolled, will trace an arc centered at the same point as the apex of the cone. The cone will travel along this path freely with no slipping between the surfaces. Second, two cones sharing the same apex and placed side by side will roll one on the other without slipping along the line of contact. As will be shown below, by choosing the proper ratio of circumferences between the first mentioned cone and the arc traced in the plane of the flat surface, the cone will roll an integral number of revolutions as it travels one revolution about the traced arc. Similarly the proper choice of circumference ratios of cones will produce integral rotations with each other and the arc. Therefore, discrete locations of the cone will always match up with discrete locations along the arc in the flat surface. Accordingly, a special case of synchronous motion may be defined.

The two cones and the flat surface may be driven in synchronism by a proper gearing arrangement, from which a device may be produced which will establish pattern registration from one set of cones to another and the surface as hereinafter illustrated.

The present invention relates to a flexible print device which may be operated in various ways to establish a degree of versatility not heretofore available in the prior art. It is especially adapted for printing multicolor designs on flat, hollow, and other odd shaped ware inside or out, with high quality, speed, and simplified set up for each of the various types of ware to be decorated. There is also disclosed the relation of ware shape to that of an actuating head.

In a series of related U.S. patent applications Ser. Nos. 332,722; 332,724; 332,725 and 332,726 filed this same date and assigned to the assignee herein various devices for use with the present invention are disclosed in detail. It should be understood that, to the extent necessary, the teachings of said applications should be considered incorporated by reference herein.

SUMMARY OF THE INVENTION

The apparatus of the present invention includes a flexible membrane pickup surface for receiving thereon one or more color portions of a design. A backing member is provided in opposition to a design receiving side of the membrane to rigidly locate it in a plane while receiving the color. Said backing member has pore openings therein coupled to a source of reduced atmosphere for drawing the membrane thereagainst. In a printing mode the membrane is pressed against a ware surface by means of a pressing head having a shape causing a selected contact angle across the ware surface.

DESCRIPTION OF THE PREFERRED EMBODIMENT

Copending U.S. patent application Ser. No. 332,726, referred to above, describes the general configuration of a decorating machine especially adapted to rotatably carry collector or pickup surfaces for engagement with circumferentially located print stations, to thereby receive multicolor design portions therefrom. In one embodiment, the collectors were described as arc segments fixed in position on a turret table. In another, the arc segments were replaced by the ware itself, held in position by a vacuum device. In yet another embodiment detailed herein, a flexible membrane device is utilized as a collector to first receive the design, and thereafter to transfer it to ware by means of a specially formed print head. Although a flexible print device is shown in U.S. Pat. No. 3,868,901, it is a more complex device, and not adapted for the index positioning of the present invention. Further, the device uses solvent based inks and is balloon actuated or biased, thereby severely limiting its versatility.

Figure 1:
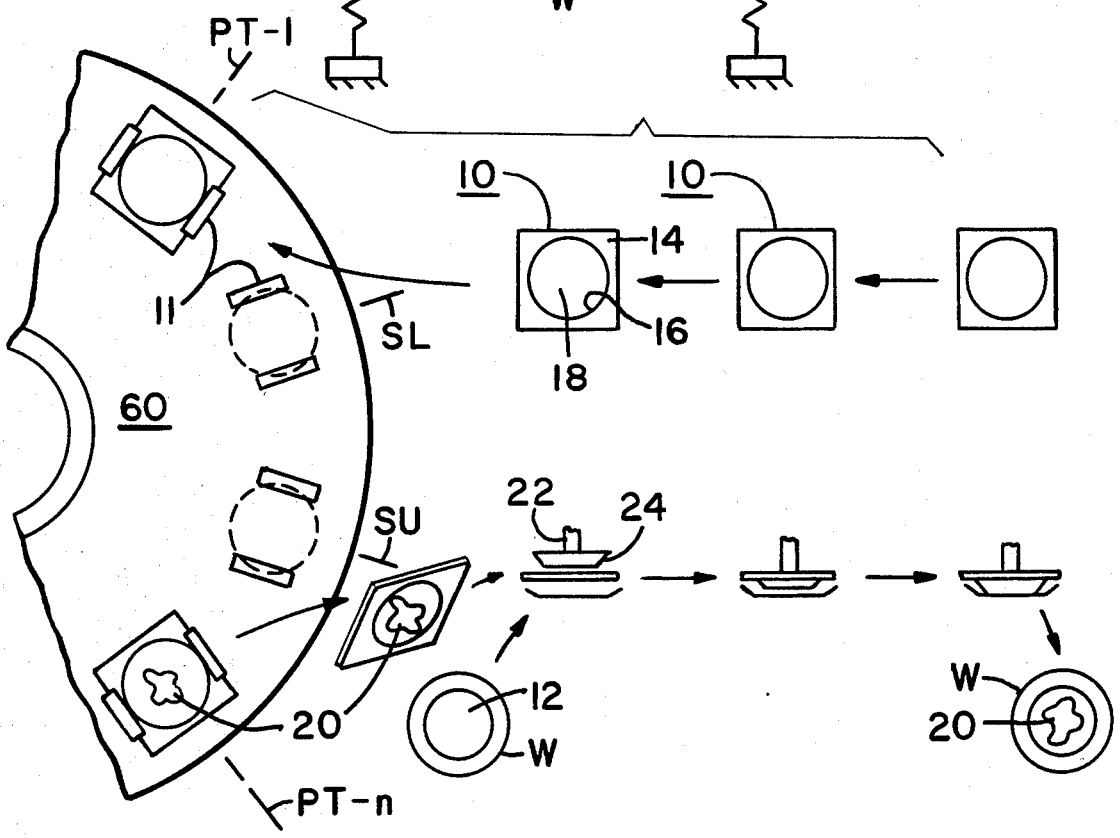
FIG. 1 is a schematic of a printing apparatus utilizing a flexible membrane pickup surface and its relation to ware throughout in said apparatus.

In a preferred embodiment of the present invention, means is provided for printing the entire inside surface portion of ware. In FIG. 1 for example, one or more membrane collectors 10, sometimes hereinafter referred to as collectors 10, may be adapted for providing a full print onto the inside surface 12 of a piece of hollow ware W. Each collector 10 includes a frame member 14 of a rigid material having an opening 16 into which is disposed an elastic membrane or elastomer 18. In this arrangement, each collector 10 may be periodically indexed into slides 11, carried by a turret 60, at a loading station SL. Collectors 10 are rotated about turret 60 in a direction shown by the arrows, successively engaging print transfer devices (not shown) located at print transfer stations PTl–PTn about turret 60, until they receive thereon the full extent of the various colors of a design 20. (See Ser. No. 332,726 for a full description of turret 60 and other components.) Each collector 10 is then indexed or removed from the turret 60 at unload station SU, and is thereafter aligned for engagement with a piece of ware W as illustrated, either manually or by means not shown. The ware W is placed below the membrane collector 10 and a piston 22, having a specially shaped face or head 24 hereinafter described, engages with the elastomer 18. The shaped face 24 distorts the elastomer 18, and the membrane engages the ware W so that both the membrane and elastomer intimately conform with the entire surface of the inner portion 12 thereof. Thereafter the piston 22 is withdrawn and the ware W has the design 20 transferred thereto on all or part of the inside surface 12, as desired. Thus, full coverage of hollow ware can be accomplished using the flexible membrane collector technique.

Figure 2A:
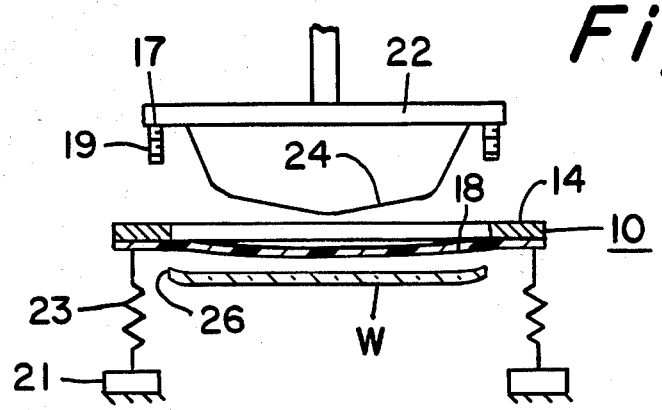
FIGS. 2A and 2B are schematic side sections of a flexible membrane pickup surface in a printing mode in two positions.
Figure 2B:
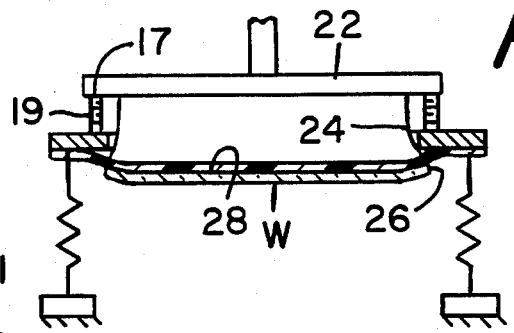

FIGS. 2A and 2B show, in schematic cross section, a detail of the arrangement illustrated in FIG. 1, wherein the ware W may be a glass or glass-ceramic article. The collector 10 is placed above the ware W. The elastomer 18 extends beyond a rim portion 26 of the ware, and is distorted by the shaped face or head 24 which is urged thereagainst. The material forming the elastomer 18 is preferably a silicone compound such as a Dow Corning "L" type room temperature vulcanizing Silastic (DC-L-RTV), having a selected affinity for the thermoplastic inks forming the design 20 greater than that for the apparatus at transfer stations PTl–PTn (e.g., transfer cone 32 hereinafter noted) and less than that for the ware W. (For other suitable materials and applications thereof see also U.S. Pat. Nos. 4,280,939, 4,261,749 and 4,292,104. All of the above being commonly assigned to the assignee herein, and incorporated herein by reference as necessary.)

The frame 14 of collector 10 is supported or carried in position above ware W by support 21 and spring 23 engaging frame 14, thereby allowing the membrane collector to float in place. Adjustable stops 19, mounted to peripheral edge portion 17 of piston 22, engage frame 14 to limit distortion of membrane 18 by some selected amount as the head 24 advances against elastomer 18. Thereafter the plunger 22, head 24 and distorted membrane collector 10 move together to engage the membrane with suitably supported ware W. It can be appreciated that the ware W, piston 22 and collector 10 may all be moved relative to each other.

Figures 3, 3A:
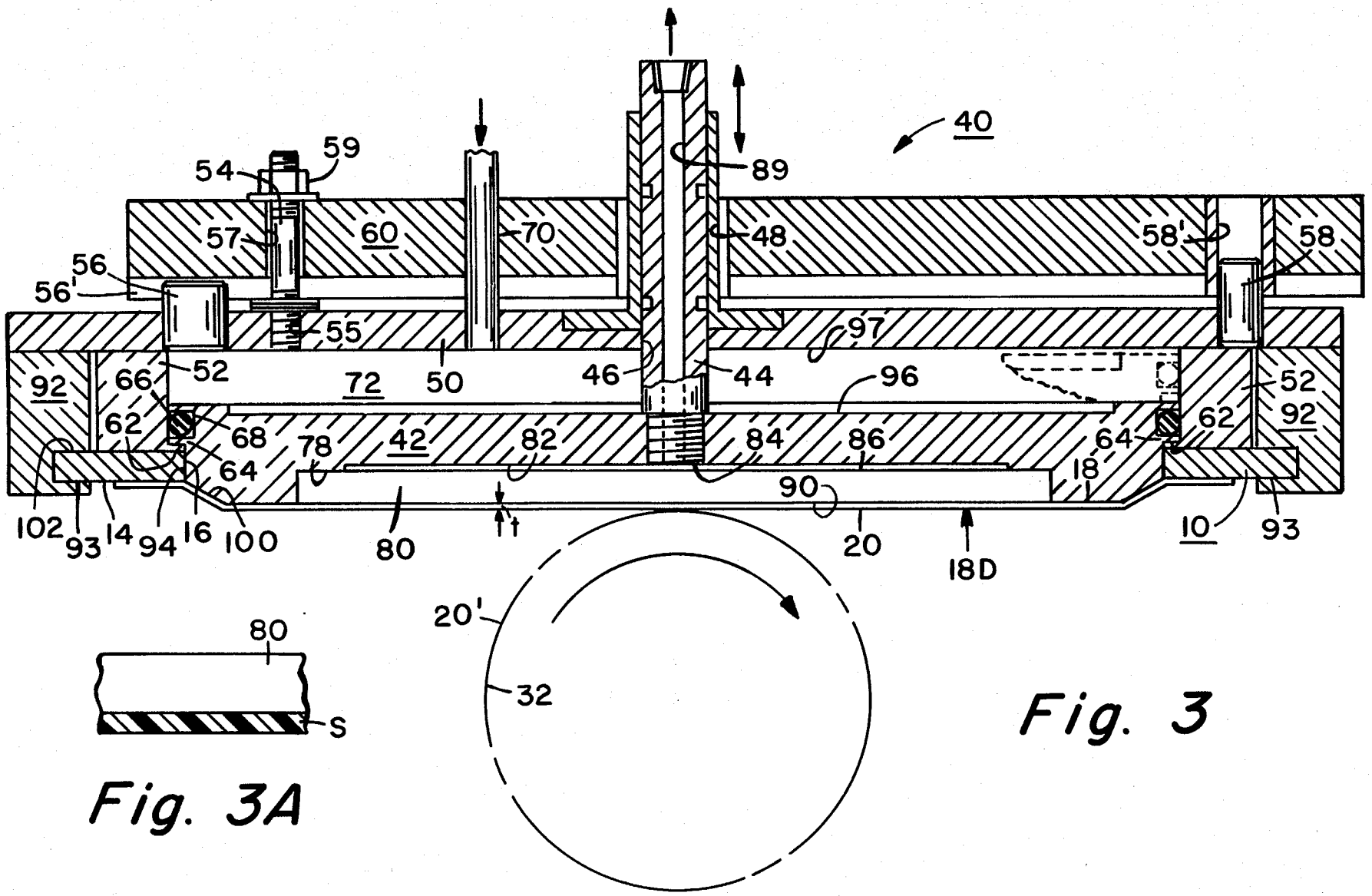
FIG. 3 is a side section elevation of a backing member for supporting the flexible membrane.
FIG. 3A is a fragmented detail of an alternative embodiment adapted from FIG. 3.

In FIG. 3 details of a backing device 40 for membrane collector 10 are illustrated. The turret 60 carries the backing device 40. A transfer cone 32 (in phantom) carries a portion 20' of the design 20 for printing to the design carrying side 18D of membrane 18. The backing device 40 includes a reciprocally movable plunger 42 carried by an apertured centering pin 44, sleeved within opening 46 of a back wall 50 of the backing device 40. The pin 44 is sleeved through an opening 48 in turret 60.

Depending sidewalls 52, appropriately secured to back wall 50, form a cylinder or cavity 72 in which plunger 42 is free to reciprocally move between the extended downward position, shown in solid lines, to the upward retracted position, shown in fragmented phantom. Sidewalls 52 include inwardly extending ears 62, and are adapted to engage and overlap outwardly extending lower ears 64 adjacent slot 68, formed in a peripheral margin of plunger 42, to thereby limit movement of, or form a stop for, plunger 42. The circumferential slot 68 in plunger 42 receives "O" ring 66, to form an air seal between plunger 42 and sidewall 52 of cylinder 72. Backing device 40 is secured to turret 60 by means of tie bolts 54, threaded at one end in opening 55 of back wall 50 and passing through opening 57 in turret 60, with nut(s) 59 holding the tie bolt(s) 54 from above. Centering pins 56 and 58, respectively located in a slot 56' and sleeved opening 58' in turret 60, accurately establish the position of backing member 40. In the position shown, plunger 42 is downwardly extended and engaged with membrane collector 10 by action of positive pressure over line 70.

The plunger 42 has a recess 78 and counterbore 82 therein, the former for receiving a porous ceramic plate 80, such as a ceramic material sold under the tradename TEGRAGLAS sold by 3M Co., grade 55 (55 micron pore size), or a plastic tradenamed POREX sold by Glasrock Prod. Inc. Porous metals may be used if the pore size is relatively small. The materials noted above have or should have interconnected pores so that if some pores become blocked, negative pressure may be maintained.

Compressible but fairly rigid materials such as felt, cloth or foam rubber may also be used in lieu of or in combination with the small porous plate 80. Such alternate materials may also be used as a skin S (see FIG. 3A) over the porous plate 80, which would allow for a larger pore size. Such a skin S would add resiliency to the support of membrane 18 and correct errors in contact pressure between transfer cone 32 and the membrane 18. This is especially useful if the membrane 18 is a relatively thin sheet of flexible material. In a preferred embodiment the membrane has a thickness t of about 0.060 mm. Other thicknesses are useful for other applications.

Counterbore 82 allows communication of one end 84 of apertured pin 44 with the entire back surface 86 of plate 80. Apertured pin 44 is coupled to a source of reduced air pressure (not shown) over air line 89 therein. Thus a vacuum may be drawn against front face 90 of plate 80.

Collector 10 is secured laterally in slots 93 of slide blocks 92 (reference numeral 11 in FIG. 1) carried by back wall 52. In a preferred embodiment the TEGRAGLAS, brand material (55 micron pore size) works well without leaving surface irregularities on the design side of the membrane surface. Lateral side margins 94 of plunger 42 engage opening 16 of the membrane frame member 14, thereby locking the collector in position between blocks 92 and plunger 42. Alignment surfaces 100 of the plunger prevent jamming as plunger 42 extends into opening 16, upon application of air over line 70, when the collector is located as illustrated. The membrane 18 may be drawn against plunger 42 by reduced air pressure through plate 80. Thus the membrane is maintained flat and may be printed by roll 32 without distortion.

Once the membrane 18 receives the design portion 20 on surface 18D, reduced air pressure or vacuum drawn over line 89 may be interrupted to free membrane 18. Thereafter the piston may be withdrawn to an upward position via reduced air pressure over line 70 (see fragmented phantom). In this position, plunger 42 is withdrawn from opening 16 in frame 14 so that alignment surfaces 100 of plunger 42 clear upper edge 102 of frame 14. The membrane collector 10 may then be withdrawn from slide blocks 92 (out of page). Thereafter another membrane collector may be inserted therein and pressure applied over line 70 to drive plunger 42 down, locating frame 14 while vacuum is drawn in line 89 to draw the membrane 18 flush with front face 90 of plate 80. Counter recess 96 in plunger 42 provides a clearance with inside face 97 of back wall 50, and assures that applied air over line 70 is evenly distributed over the back side of plunger 42.

Figure 4:
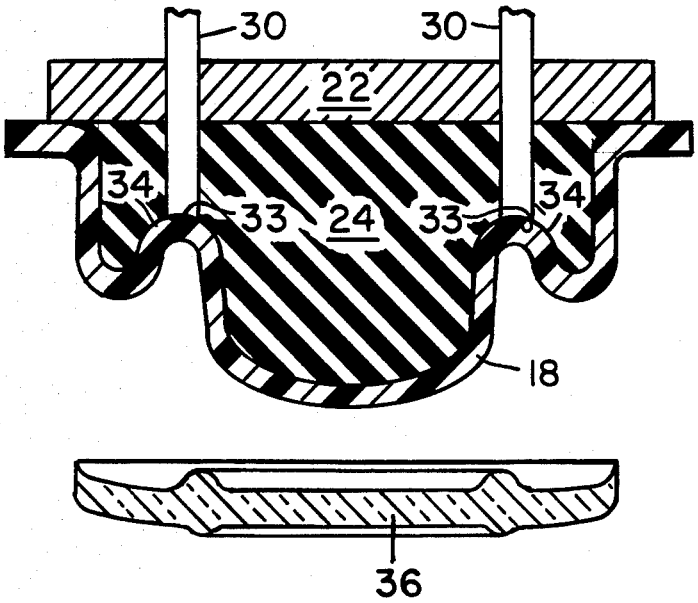
FIG. 4 is a cross section of a printing head for a special case of a convoluted saucer.

Reference is now directed back to FIGS. 2A and 2B and also to FIG. 4. As explained previously, the design 20 on the design side 18D of elastomer 18 transfers onto the ware W by intimate contact. The present invention makes it possible to print odd shaped ware contemplated herein, provided the head 24 of the printing plunger 22 is appropriately shaped. When the head 24 engages elastomer 18, the latter is stretched or deformed into conformance therewith. Together the stretched elastomer 18 and head 24 engage the ware W, center first, so that there is no trapped air during the printing operation. Shaped face 24 also distorts to conform to the ware contour from the center outwardly to the rim 26. Thus, the print proceeds in a rolling-like motion from the center 28 to the rim 26 of the ware W. Rolling-like contact may be characterized as instantaneous rolling motion at each instantaneous point of contact of the membrane 18 and ware W. Preferably the head 24 has a configuration which, when it engages with the membrane 18 and thereafter the ware W, a contact angle of about 15° is maintained with the ware W. The shape of head 24 is determined as hereinafter described.

FIG. 4 illustrates a special case. A vacuum line(s) 30 coupled to a source of reduced air pressure (not shown) is located in the plunger 22 and extends through head 24 to an opening(s) 33 in convolutions 34 thereof. In the event the shape of head 24 requires internal convolutions 34 by virtue of the shape to be printed (e.g., see profile of a typical saucer 36), means is required to cause membrane 18 to accurately conform to the head shape. In the example illustrated in FIG. 4, the membrane 18 may be drawn into the convolutions 34 by means of reduced air pressure. Thus, the design may be accurately transferred to the ware W.

Figure 5:
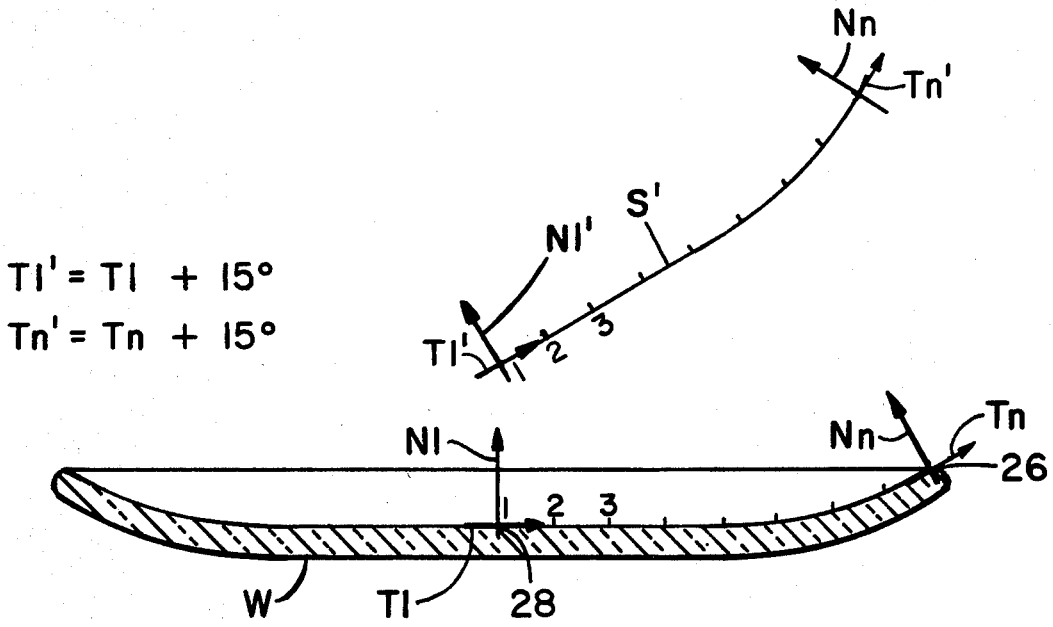
FIGS. 5 and 6A and 6B graphically illustrate methods of determining a ware head shape.

To derive the proper shape for the head 24, a number of useful methods are available. One for example, illustrated in FIG. 5, relies on an empirical trial and error graphical approach, which begins with an analysis of the shape of the ware W. Choosing a number of radial spaced points 1–n, along the surface of the ware to be printed extending from the center 28 to rim 26, determine tangents $T_1$–$T_n$ at each respective point 1–n (i.e. tangents are perpendicular to corresponding normals Nl–Nn). Rotate the tCangents by a selected number of degrees to positions $T_1'$–$T_n'$, thereafter reconstruct a surface S' formed of a series of said rotated tangents $T_1'$–$T_n'$. A reasonably good first approximation of a required head shape (less membrane thickness) can be derived from a simple surface. Unfortunately, the method may require a number of iterations and manual reshaping of the head derived thereby to be satisfactory. The requirement for multiple iterations even for a simple shape is time consuming and costly.

A preferred method of derivation results from a mathematical approach using finite element analysis. See for example *Finite Element Analyses: Fundamentals,* Richard H. Gallagher, Prentice Hall Inc., 1975 and *The Finite Element Method,* 3rd Ed., O. C. Zienkiewicz, McGraw Hill Book Company (U.K.) Limited, 1977. The principles outlined in the above works provide a methodology for the use of finite element analysis as a technique in the solution of many engineering problems. Because the mathematics of finite element analysis is matrix oriented and complex, the technique is particularly adapted for use with a digital computer compatible with commercially available special purpose programs. For example a program known as ANSYS is specifically useful with the technique. By dividing the given head 24 into a group of connected figures or elements and defining boundary conditions for the element geometry, solutions may be derived by use of progressive computer runs to derive various shapes.

Figure 6A:
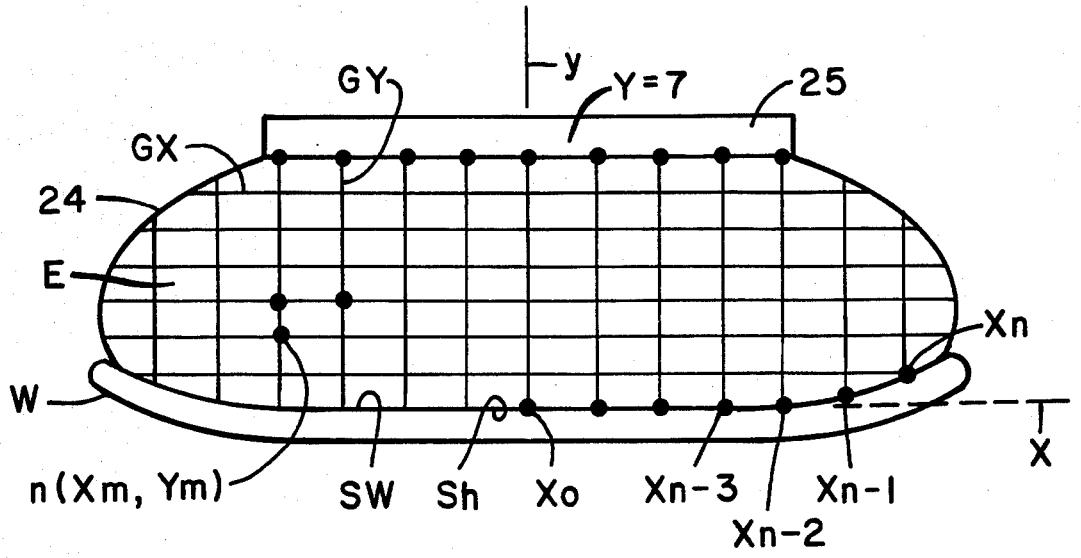
Figure 6B:
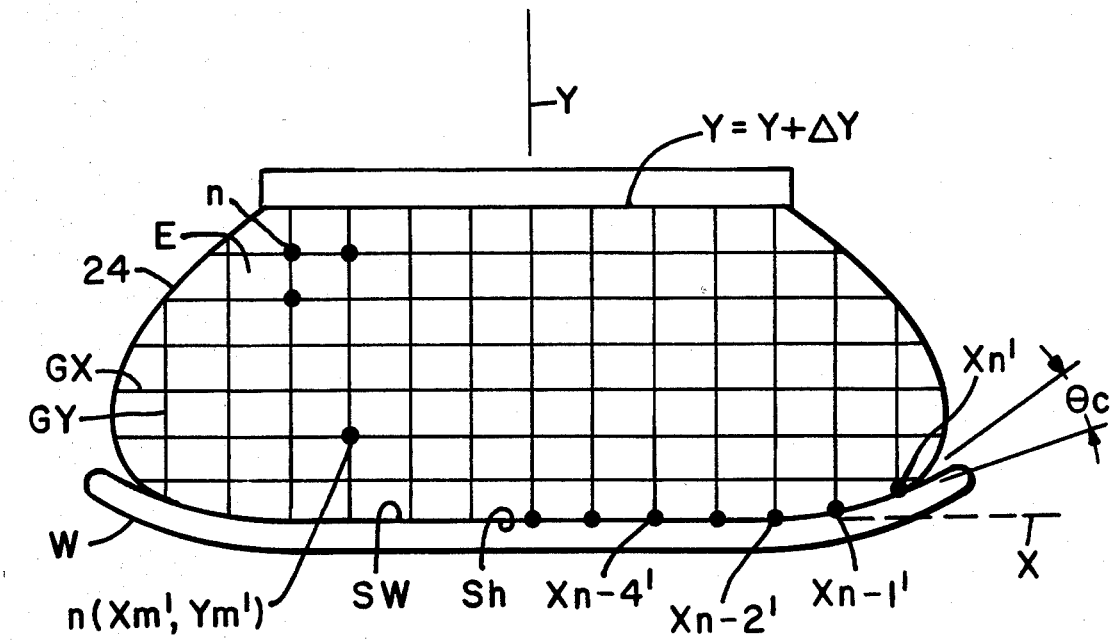

In the preferred process of finite element analysis as used herein and illustrated in FIGS. 6A and 6B, a two dimensional model of the object (herein head 24) is broken down into a selected number of connected rectangular elements E by a series of intersecting respective horizontal and vertical grid lines $G_X+G_Y$ in an XY coordinate system. Intersections of the grid lines $G_X-G_Y$ are called n nodes (see dots). In the X-Y coordinate system each node n has initial coordinates e.g. Xm, Ym. As the object is stressed or deformed by a given amount, boundary conditions may change and each node may move. The computer solves the general equations of stress, etc. during a run to determine new coordinates Xm', Ym' (see FIG. 6B) resulting from the given stress, and the latter form a bank of data establishing initial conditions for the next computer run. By successive runs a shape for plunger is derived. If it is not workable, the equations of stress may be modified and initial conditions changed to derive a new shape. Also the head 24 may be manually reformed. The method of finite element analysis greatly accelerates the process to solution.

In attempting to determine various heads for use with various corresponding ware shapes it was found extremely useful to approach the problem in an unconventional way. The conventional solution in finite element analysis is to take an arbitrary shape and determine the resulting shape as it is deformed. In the present situation, the shape into which the plunger or head 24 must be deformed (i.e. ware shape) is defined, therefore the final deformed shape of the head 24 is known. Thus, the analysis begins with a deformed head shape as seen in FIG. 6A and is iterated back to an initial or desired starting head shape by successive release of the head 24 away from ware W (see FIG. 6B). By applying negative stress, (i.e. moving the stressed or deformed head 24 away from ware W) and solving the stress equations in reverse a head shape evolves more quickly.

Another feature of the method is to constrain the stress release of head 24 by limiting the motion of each run to some small amount (e.g. 0.01" per iteration). Further it is a constraint that certain nodes n along the portion of the head 24 in contact with ware W and certain ones in contact with a support member 25 are not free to move. For an example in the latter case, see FIG. 6A wherein nodes in line Y-7 are colinear with the side of support member 25 and are not free to move except in the Y direction. Thus each successive position thereof is given by the amount of upward motion of the support 25 given for each iteration. In FIG. 6B the nodes along line Y-7 always have known positions determined by the change in the position of the support member 25, that is $Y+\Delta Y$. For the former case, while all nodes n along the interface of the ware surface SW and head surface Sh may theoretically move, i.e. points Xn, Xn-1, Xn-2, etc., certain points are fixed for the calculation. In the preferred arrangement nodes along surface Sh of head 24 in contact with ware W are not free to move, except those nodes which are within three nodes of the extreme radial contact with the ware. Thus, in FIG. 6A this includes Xn through Xn-3. In the next iteration, if Xn′ is still in contact with ware i.e. Xn=Xn′, the same constraint applies. If, however, Xn≠Xn′ the Xn-1′ becomes the first node out of contact with ware thereby freeing Xn-4′, and so on as the head 24 is successively withdrawn.

Finally and very importantly the angle of contact θc of the head 24 and ware W at a point where the head 24 separates therefrom (e.g. Xn′) is constrained to a range of about 5° to 50°. The larger the angle of contact angle θc the lesser coverage may be accomplished. It has been found that a contact angle θc of about 15° is optimal since full coverage may be attained and ware warpage variations are accommodated.

Initially all node points are given coordinates Xm,Ym relative to the respective grid lines Gx,Gy forming the element. After iteration, there results a series of numbers representing new positions for the nodes Xm′,Ym′. The resulting shape of the head 24 may be analyzed at the contact point and the contact angle θc calculated. If the resulting contact angle θc at Xn′ is different (±) than the required or optimized angle, i.e. 15°, the resulting contact angle θc may be compared with 15° in the form of a ratio:

$$15°/\theta = \pm g$$

The number g may then be used as a multiplier for each coordinate X′,Y′ in the network of newly calculated nodes in FIG. 6B, to move its corresponding position linearly (+) or (−) by the amount represented by g. Thus, the data base after the so-called first run is updated or modified by g to yield a set of further modified coordinates X″,Y″ where g·(Xm′,Ym′)=(X″,Ym″). Thereafter the computer program may be re-run with the modified corrected first run data base, i.e., X″,Y″. This modification of data is done for each run of ΔY.

The resulting shape of head 24 is defined by the final calculated modified data base after the head is fully withdrawn from the ware W. Doubtless certain changes may be required in the final shape of head 24, but the above described process substantially reduces trial and error. It should be appreciated that the above described methods are not the only ones available but are believed to be the most appropriate and preferred methods for deriving a head shape. Also, membrane thickness t is subtracted from the head shape.

It can be appreciated that in addition to full coverage of ware W, the membrane 20 may be stretched by head 24 such that the decoration is enlarged from its initial size on the unstretched membrane 20. Thus, there is provided a versitile device which may be useful in printing various sized articles of ware without significant changes in apparatus set up.

While there have been described what are considered to be the preferred embodiments of the present invention, it will be apparent to those skilled in the art that various changes and modifications may be made therein without departing from the invention, and it is intended in the appended claims to cover all such changes and modifications as fall within the true spirit and scope of the invention.

I claim:

1. Apparatus for printing an article utilizing a design carrying working surface comprising:

a frame having an aperture therein, a flexible elastic membrane carried by said frame, said flexible membrane having a working surface forming a portion of said membrane and disposed over said aperture;

means for supporting the flexible working surface of the membrane for application of a separable design thereon including a housing, and a porous plate mounted within said housing having a free face for engaging an opposed rearward facing portion of said flexible working surface; and means coupled to said housing for supplying reduced air pressure relative to atmospheric pressure for establishing a reduced air pressure relative to ambient atmosphere at the free face of said porous plate, and for drawing said rearward facing portion of the flexible working surface against said free face of the porous plate to secure said membrane in close contact therewith;

flexible actuator means having a deformable solid pre-shaped face engagable with said flexible membrane opposite the design carrying working surface thereof for deforming said membrane into conformance with said pre-shaped face of the flexible actuator means; means for positioning the article adjacent the deformed membrane;

means for driving the actuator means and for moving said deformed membrane having the shape of said pre-shaped face into engagement with the article in a nonslip simulated rolling contact, from a center area thereof to an outer peripheral edge, at a selected contact angle of between 5° and 50°, for separating the design portion from the membrane and transferring the same to the article; and said membrane having a selected affinity for the design portion less than that of the article so that upon contact with said article the design portion transfers to the article.

2. The apparatus according to claim 1 wherein the contact angle is about 15°.

3. The apparatus according to claim 1 further including at least one adjustable spacer member for engaging the actuator means and frame so as to establish a fixed spacial relationship therebetween.

4. Apparatus according to claim 1 wherein said porous plate is selected from a porous material having a pore size of about 50 microns.

5. Apparatus according to claim 1 wherein said porous plate comprises a rigid member, and a compressibly resilient skin is located intermediate said rigid porous plate and the flexible working surface.

6. Apparatus for printing an article with a separable design portion from a design carrying working surface comprising:

a frame having an aperture therein and a flexible elastic membrane carried thereby, the flexible membrane having a working surface formed of a portion of said membrane and disposed over said aperture;

means for supporting the flexible working surface of the membrane during application of the separable design thereon including a housing; a porous plate having a free face for engaging an opposed rearward facing portion of said flexible working surface being mounted within said housing; and a source of reduced air pressure relative to atmospheric pressure coupled to said housing for establishing at the free face of said porous plate a reduced air pressure relative to ambient atmosphere, said rearward facing portion of the flexible working surface being adapted to be located against said free face of the porous plate and drawn thereagainst to secure said membrane in close contact therewith;

flexible actuator means having a shaped face adapted to engage the membrane opposite the design carrying working surface thereof causing deformation of the membrane into conformance with said actuator means; means for securing the article into opposition with the deformed membrane; and means for driving the actuator means and moving the membrane into engagement with the article in a nonslip simulated rolling contact, from a center area thereof to an outer peripheral edge, at a selected contact angle, for separating the design portion from the membrane; the membrane being formed of a RTV silastic having a selected affinity for the design portion less than that of the article so that upon contact with said article, the design portion transfers to the article; the design portion being selected from materials consisting essentially of thermoplastic inks;

means for slidably securing the frame to the housing in alignment with the porous plate;

an apertured piston having a recess therein for securely receiving the porous plate in communication with the aperture, the piston being reciprocally mounted within said housing, and said piston extendable to a first position for engaging the aperture in the frame to lock the frame in the support means and retractable to a second position withdrawing the piston from the frame aperture for unlocking the frame relative to the support means.

7. Apparatus according to claim 6 wherein the means for slidably securing the frame includes a notched support plate mounted to the housing for receiving a mating peripheral portion of the frame therein.

8. Apparatus according to claim 6 wherein the piston and housing each include stop means for engaging one with the other for establishing the first and second positions.

9. Apparatus according to claim 6 wherein the housing has a piston-receiving open ended chamber bounded by a back wall and depending sidewalls, and said piston being reciprocally located therein.

10. Apparatus according to claim 9 wherein said piston includes an outer peripheral groove and an O ring located therein engaging with the sidewalls of the chamber for forming an air seal.

11. Apparatus according to claim 9 wherein a rearward portion of the piston includes a counterbored recess therein for establishing at least a minimum space between said piston and back wall, and the housing includes pneumatic means communicating with at least said minimum space for causing the piston to move into the first position under pneumatic pressure and move to the second position under reduced pneumatic pressure.

12. A method for printing articles comprising the steps of:

at a plurality of transfer stations, supporting a flexible working surface against a plate of selected relatively small porosity, pneumatically drawing the flexible working surface thereagainst without distortion thereof; and sequentially applying a portion of a separable design thereon, until a complete design is applied thereto;

selecting the working surface from silastic materials having an affinity for the design less than the article; and selecting materials for the design from thermoplastic compounds;

at a print station, moving a flexible actuator having a deformable solid pre-shaped face into engagement with said working surface in opposition to the design carrying side thereof to deform a portion of said working surface into conformance with a selected profile; and then driving the so deformed working surface into engagement with a design receiving surface of the article in a nonslip rolling-like contact having a selected contact angle of between 5° and 50° to thereby separate the complete design from the working surface and transfer it to the article;

selecting the profile for conformance of the working surface as a function of a design receiving surface of the article to thereby have a shape adapted to engage the article first from the center to an outer peripheral edge thereof at said selected contact angle.

13. A method according to claim 12 wherein the contact angle is about 15°.

14. A method according to claim 12 further including the step of spacing the working surface in a fixed spacial relationship with the means for driving the working surface into engagement with the design receiving surface of the article.

15. A method according to claim 12 further including the step of resiliently supporting the flexible surface in engagement with a rigid porous plate.

16. A method according to claim 12 including the step of selecting the porosity of said plate to have a pore size of about 50 microns.

17. A method according to claim 12 including the step of peripherally supporting the working surface and aligning same with the porous plate.

18. A method according to claim 17 further including the step of reciprocally engaging and disengaging the porous plate and working surface and respectively locking and unlocking the working surface relative to said plate.

* * * * *